US005921567A

United States Patent [19]

Brown

[11] Patent Number: 5,921,567

[45] Date of Patent: Jul. 13, 1999

[54] SAFETY WALKER FOR A BABY

[76] Inventor: Norma Brown, 2721 Kings Highway, apt. 4M, Brooklyn, N.Y. 11229

[21] Appl. No.: 08/927,549

[22] Filed: Sep. 6, 1997

[51] Int. Cl.[6] ..... B62B 7/00

[52] U.S. Cl. ..... 280/87.051; 280/87.05; 248/188.5

[58] Field of Search ..... 280/87.051, 87.05; 248/188.5, 129

[56] References Cited

U.S. PATENT DOCUMENTS

| | | | |
|---|---|---|---|
| 3,168,271 | 2/1965 | Deschenes | 248/129 |
| 3,532,356 | 10/1970 | Lillibridge | 280/87.05 |
| 4,015,853 | 4/1977 | Summers | 280/87.02 W |
| 4,342,465 | 8/1982 | Stillings | 280/87.05 |
| 4,621,804 | 11/1986 | Mueller | 280/87.05 |
| 5,083,806 | 1/1992 | Brown | 280/87.05 |
| 5,275,426 | 1/1994 | Tankersley | 280/87.051 |
| 5,562,052 | 10/1996 | Glashouwer et al. | 108/144 |
| 5,638,772 | 6/1997 | Kaufmann et al. | 119/770 |
| 5,732,861 | 3/1998 | Jakobson | 224/160 |
| 5,774,861 | 6/1998 | Spector | 704/275 |
| 5,791,535 | 8/1998 | Roan et al. | 224/160 |
| 5,803,786 | 9/1998 | McCormick | 446/227 |

*Primary Examiner*—J J Swann
*Assistant Examiner*—Lynda Jasmin
*Attorney, Agent, or Firm*—Michael I. Kroll

[57] ABSTRACT

A safety walker (10) for a baby (12) comprising a framework (14) which surrounds an area to be occupied by the baby (12). A structure (16) is for holding the baby (12) in a secure manner within the framework (14). Components (18) are on a bottom end of the framework (14) for engaging a horizontal support surface (20) in a moveable manner, so that the framework (14) can be propelled by the baby (12) therein. An assembly (22) on the framework (14) is for protecting the baby (12), so that in a first instance if the framework (14) tips over and in a second instance if the framework (14) falls down from a height, such as a flight of stairs (24), a landing and a porch (26), the protecting assembly (22) will prevent traumatic injury to the baby (12).

5 Claims, 4 Drawing Sheets

SAFETY WALKER FOR A BABY

BACKGROUND OF THE INVENTION

1. Field of the Invention

The instant invention relates generally to baby walkers and more specifically it relates to a safety walker for a baby. The safety walker for a baby is an improvement on the safety features of current baby walker, which can cause traumatic injury when they tip over or fall from heights, such as on stairs, landings or a porch.

2. Description of the Prior Art

Numerous baby walkers have been provided in prior art that are adapted to help develop babies leg muscles, so as to teach babies how to walk. While these units may be suitable for the particular purpose to which they address, they would not be as suitable for the purposes of the present invention as heretofore described.

SUMMARY OF THE INVENTION

A primary object of the present invention is to provide a safety walker for a baby that will overcome the shortcomings of the prior art devices.

Another object is to provide a safety walker for a baby that is an improvement on the safety features of current baby walkers, whereby the current baby walkers can cause traumatic injury when they tip over or fall from heights, such as on a flight of stairs, on landings or on porches.

An additional object is to provide a safety walker for a baby that contains a retractable leash restricting the distance of travel and a microphone thereon, to monitor the baby in an audible manner.

A further object is to provide a safety walker for a baby that is simple and easy to use.

A still further object is to provide a safety walker for a baby that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Figure 2:
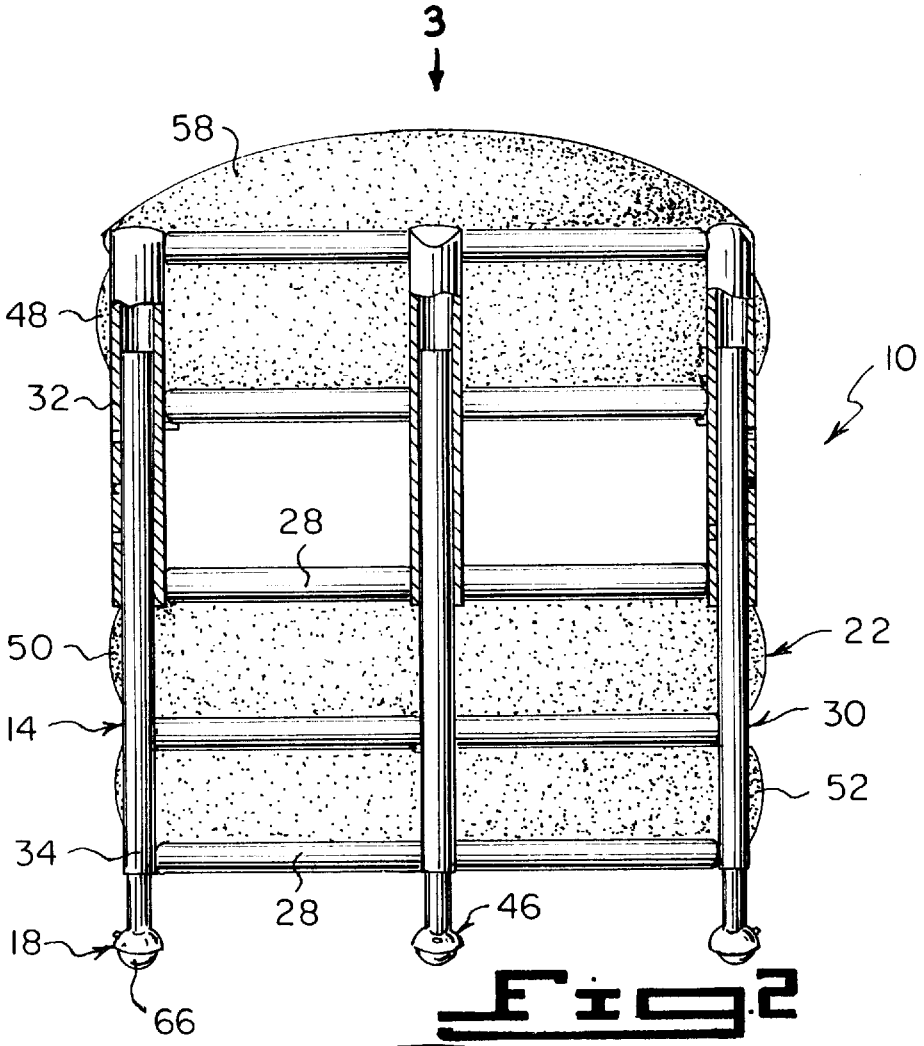
FIG. 2 is an elevational view of the present invention per se with parts removed and in section.
Figure 2A:
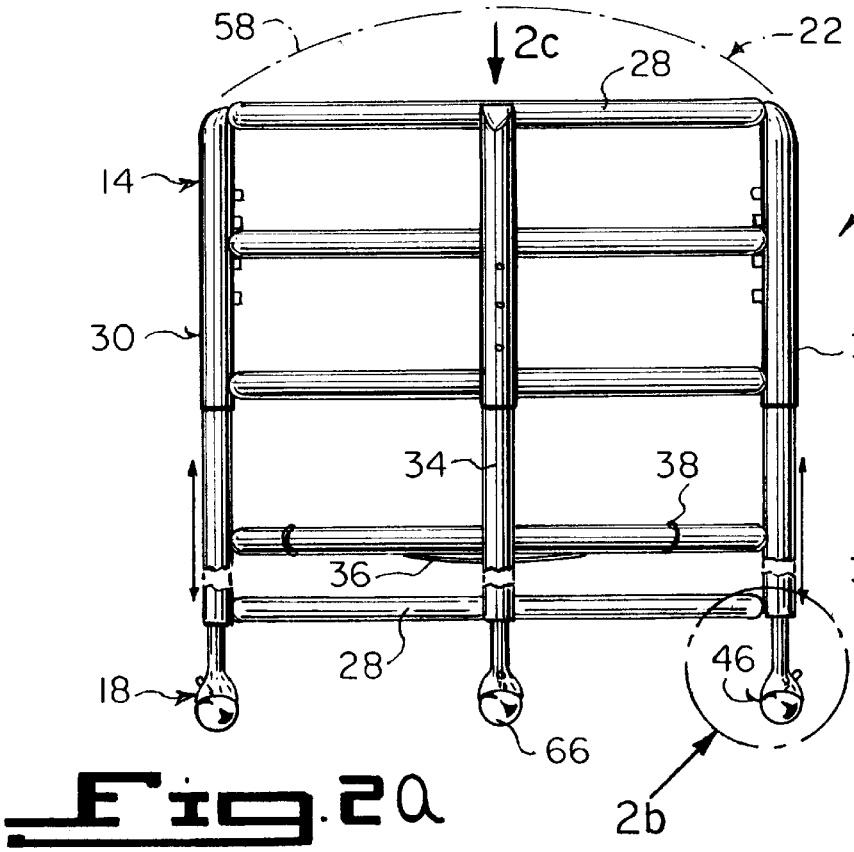

FIG. 2*a* is an elevational view similar to FIG. 2, of just the height adjustable framework with parts broken away.

Figure 2B:
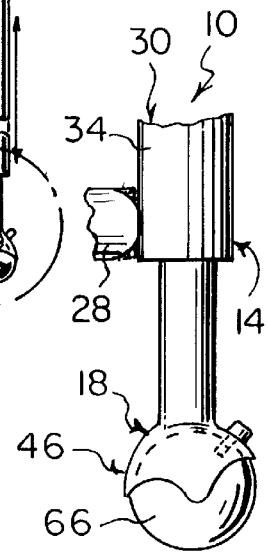

FIG. 2*b* is an enlarged elevational view of an area of FIG. 2*a* indicated by arrow 2*b*, showing one of the lockable casters in greater detail.

Figure 2C:
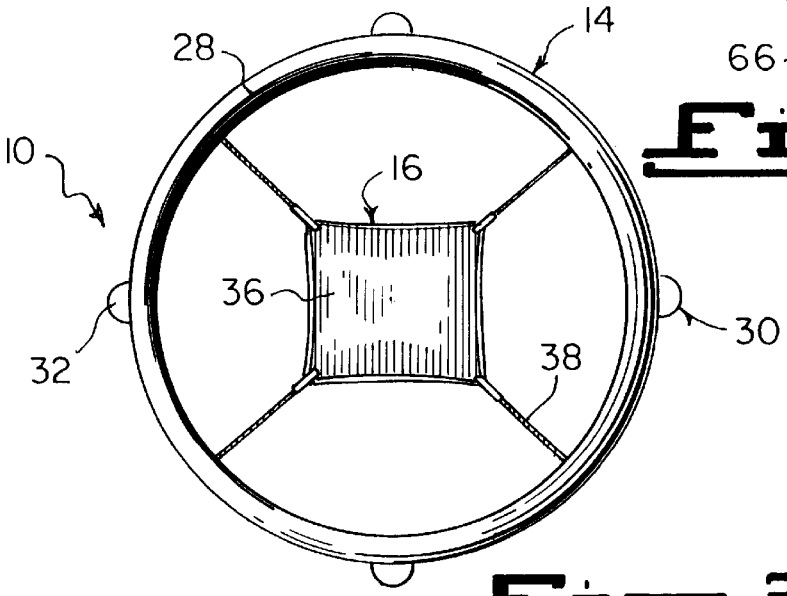

FIG. 2*c* is a top view taken in the direction of arrow 2*c* in FIG. 2*a*.

Figure 3:
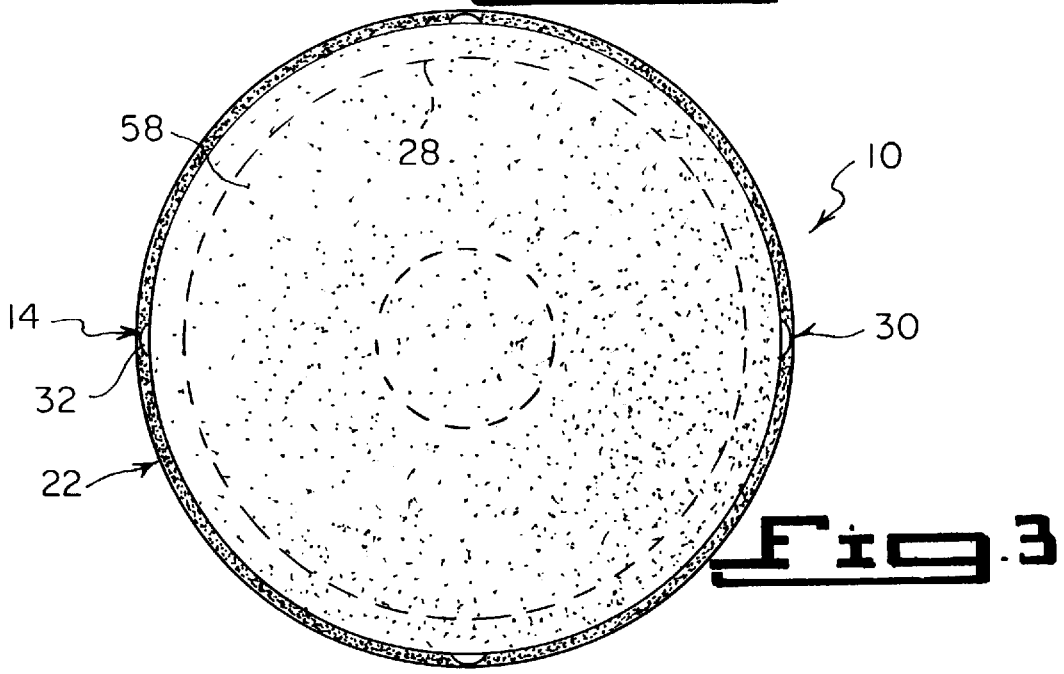

FIG. 3 is a top view taken in the direction of arrow 3 in FIG. 2.

Figure 1:
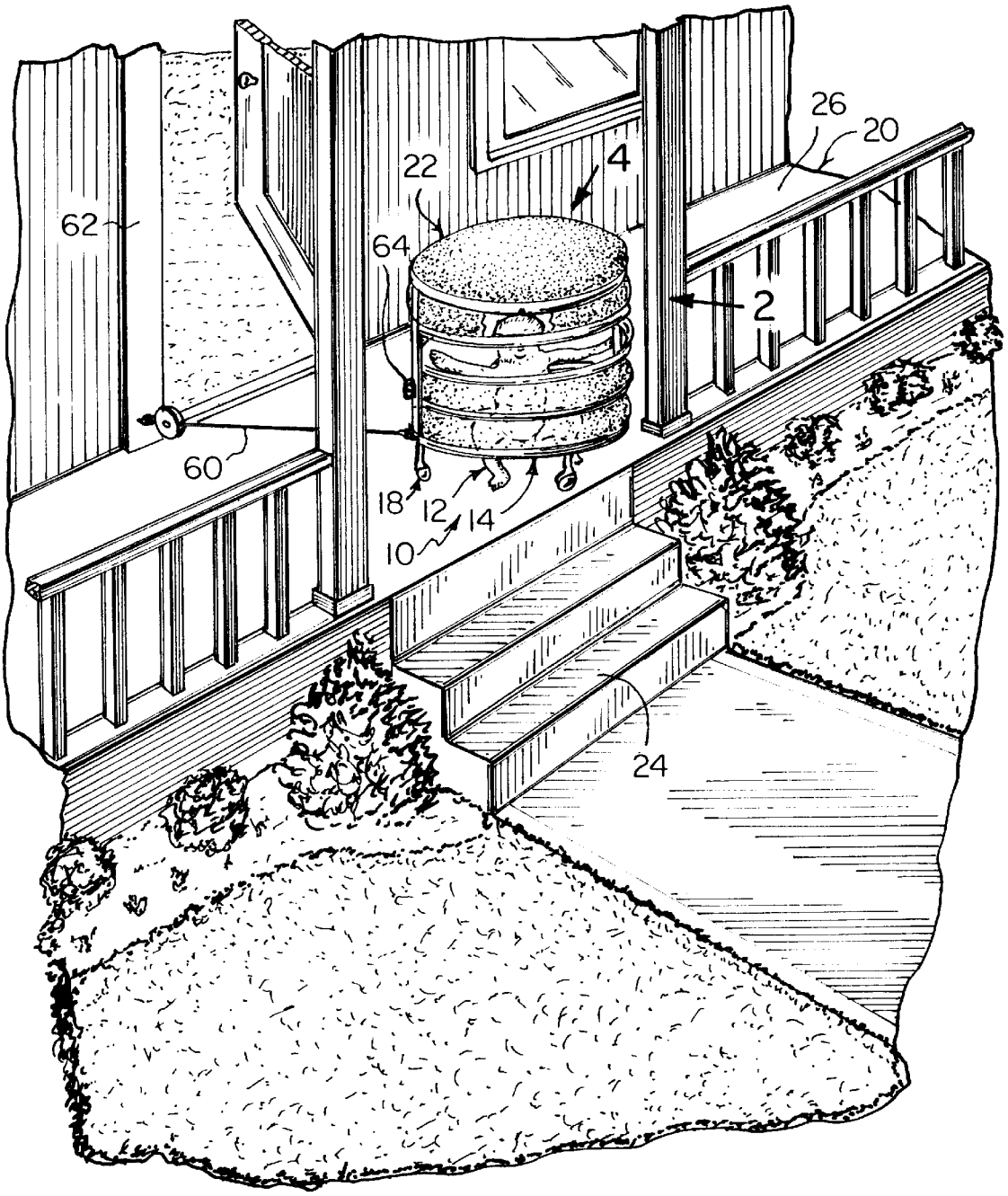
FIG. 1 is a front perspective view of the present invention with parts broken away, showing a baby therein on a porch adjacent a set of stairs of a house.
Figure 4:
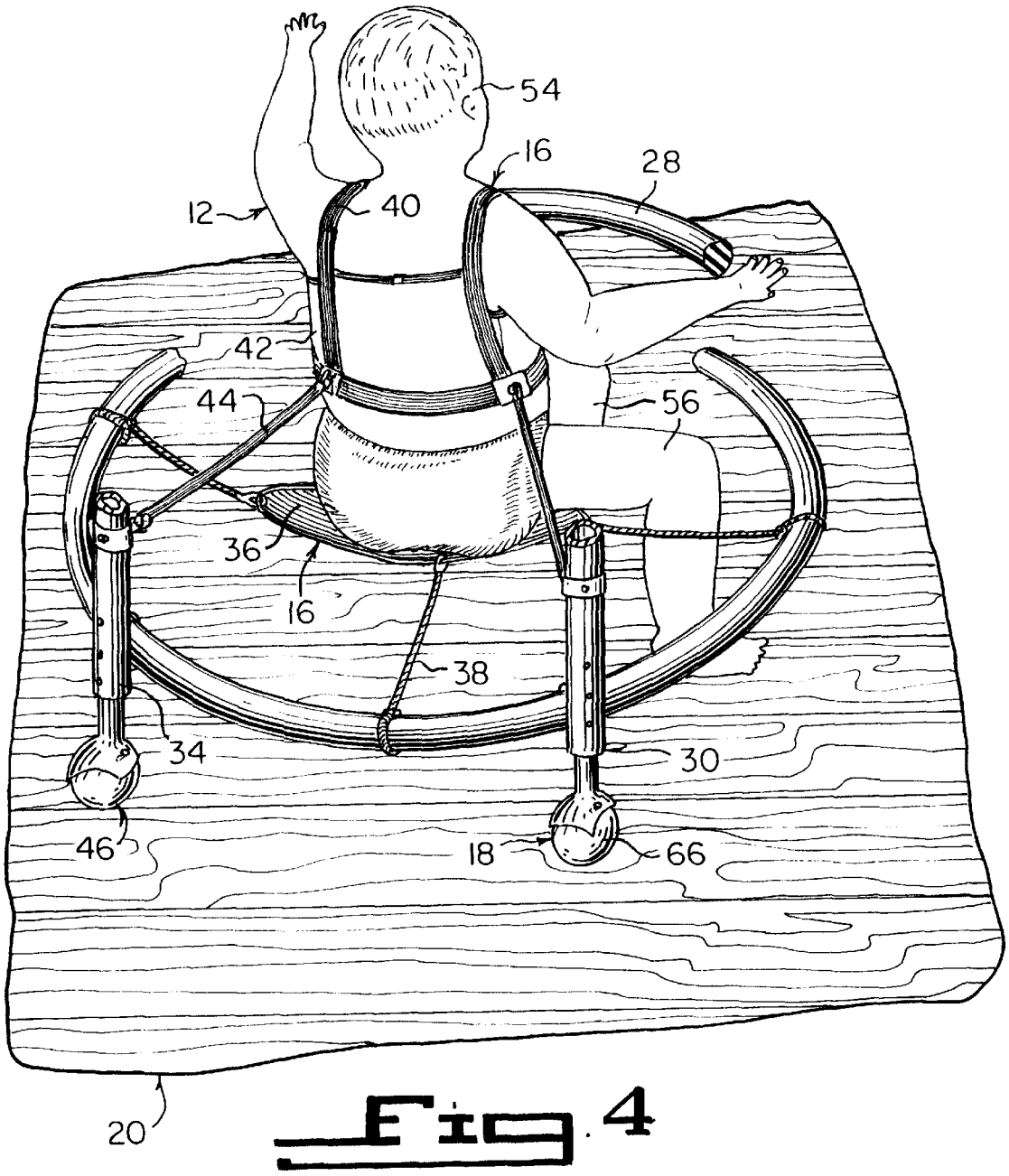

FIG. 4 is an enlarged rear perspective view taken in the direction of arrow 4 in FIG. 1, with parts further broken away and in section.

Similar reference characters denote corresponding features consistently throughout the attached drawings.

DETAILED DESCRIPTION OF THE PREFERRED EMBODIMENTS

Turning now descriptively to the drawings, in which similar reference characters denote similar elements the several views, FIGS. 1 through 4 illustrate invention being a safety walker 10 for a baby 12. With regard to the reference numerals used, the following numbering is used throughout the various drawing figures.

10 safety walker
12 baby
14 framework of 10
16 holding structure of 10
18 moveable engaging component of 10
20 horizontal support surface
22 baby protecting assembly of 10
24 flight of stairs
26 landing/porch
28 annular rail member of 14
30 stanchion of 14
32 upper hollow segment of 30
34 lower segment of 30
36 seat of 16
38 cord of 16 between 14 and 36
40 harness of 16
42 trunk of 12
44 strap of 16 between 14 and 40
46 lockable caster of 18
48 first donut shaped cushion of 22 on 14
50 second donut shaped cushion of 22 on 14
52 third donut shaped cushion of 22 on 14
54 head of 12
56 leg of 12
58 frontal dome shaped cushion of 22 on 14
60 retachable leash of 10 between 14 and 62
62 stationary object
64 microphone of 10 on 14
66 ball shaped swivel wheel of 46

The safety walker 10 for the baby 12 comprises a framework 14 which surrounds an area to be occupied by the baby 12. A structure 16 is for holding the baby 12 in a secure manner within the framework 14. Components 18 are on a bottom end of the framework 14 for engaging a horizontal support surface 20 in a moveable manner, so that the framework 14 can be propelled by the baby 12 therein. An assembly 22 on the framework 14 is for protecting the baby 12, so that in a first instance if the framework 14 tips over and in a second instance if the framework 14 falls down from a height, such as a flight of stairs 24, a landing and a porch 26, said protecting assembly 22 will prevent traumatic injury to the baby 12.

The framework 14 includes a plurality of annular rail members 28 horizontally spaced apart. A plurality of stanchions 30 are radially attached about the annular rail members 28. Each stanchion 30 is telescopic and consists of an upper hollow segment 32. A lower segment 34 slides within the upper hollow segment 32 and is retained in position therein.

The holding structure 16 comprises a seat 36 made of a flexible piece of material in a square configuration. Four cords 38 are provided. Each cord 38 extends from one corner of the seat 36 to a lower portion of the framework 14, so that if the baby 12 should lose balance and fall down the seat 36 will support the baby 12.

The holding structure 16 further includes a harness 40 worn about the trunk 42 of the baby 12. A plurality of straps 44 are removably attached between the harness 40 and a lower portion of the framework 14, to maintain the baby 12 in a stabilized position within the framework 14 at all times.

The moveable engaging components 18 consist of a plurality of lockable casters 46 mounted to the bottom end of the framework 14. The lockable casters 46 will allow the framework 14 to roll upon the horizontal support surface 20 when unlocked.

The baby protecting assembly 22 includes three donut shaped cushions 48, 50, 52 to fit upon the framework 14. The first cushion 48 will protect the head 54. The second cushion 50 will protect the trunk 42 and the third cushion 52 will protect the legs 56 of the baby 12 from injury. The baby protecting assembly 22 further includes a frontal dome shaped cushion 58, to fit upon a top end of the framework 14 to extend over the baby 14, to protect the baby 12 if the framework 14 tips over.

As shown in FIG. 1, a retractable leash 60 can extend between the framework 14 and a stationary object 62, such as part of a house, so as to restrict the distance of travel thereof. The safety walker 10 for the baby 12 can further include a microphone 64 affixed to the framework 14, so as to monitor the baby 12 in an audible manner therefrom.

The annular rail members 28 and the stanchions 30 of the framework 14 are fabricated out of a durable material such as hard rubber, plastic or metal. The seat 36 is made out of a fabric material, such as nylon or the like. The cords 38 can be elastic to allow the baby 12 to move up and down on the seat 36 when walking.

The harness 40 and straps 44 are made out of a strong webbing material. Each lockable caster 46 will include a ball shaped swivel wheel 66, to allow the baby 12 to steer the framework 14 along the horizontal support surface 20, which can be a floor within a building. Each donut shaped cushion 48, 50, 52 and the frontal dome shaped cushion 58 are fabricated out of a plastic or rubber foam material.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A safety walker for a baby comprising:

a) a framework which surrounds an area to be occupied by the baby comprising a plurality of horizontal spaced apart annular rail members vertically arranged with the first rail being on the bottom, the second rail being above said first rail, the third rail being above said second rail, the fourth rail being above said third rail, and the fifth rail being above said fourth rail, all of said rails being aligned, and a plurality of telescoping stanchions radially attached about said annular rail members;

b) means for holding the baby in a secure manner within said framework comprising a seat made of a flexible piece of material in a square configuration with a cord extending from each corner of said seat to a lower portion of said framework to support said baby;

c) means on a bottom end of said framework for engaging a horizontal support surface in a moveable manner, so that said framework can be propelled by the baby therein; and d) means on said framework for protecting the baby comprising three donut shaped cushions fitted into said framework between adjacent rail members, one of said cushions located between said first and second rails, the second of said cushions located between said second and third rails, and the third of said cushions located between said fourth and fifth rails, leaving a space between said third and fourth rails, and a frontal dome cushion fit upon a top end of said framework to extend over said baby to protect said baby should said framework tip over, so that in a first instance if said framework tips over and in a second instance if said framework falls down from a height, such as a flight of stairs, a landing and a porch, said protecting means will prevent traumatic injury to the baby.

2. A safety walker for a baby as recited in claim 1, wherein said holding means includes:

a) a harness worn about the trunk of the baby; and b) a plurality of straps, removably attached between said harness and a lower portion of said framework, to maintain the baby in a stabilized position within said framework at all times.

3. A safety walker for a baby as recited in claim 1, wherein said moveable engaging means includes a plurality of lockable casters mounted to the bottom end of said framework, so that said lockable casters will allow said framework to roll upon the horizontal support surface when unlocked.

4. A safety walker for a baby as recited in 1, further including a retractable leash extending between said framework and a stationary object, so as to restrict the distance of travel thereof.

5. A safety walker for a baby as recited in claim 1, further including a microphone affixed to said framework, so as to monitor the baby in an audible manner therefrom.

* * * * *